US005592857A

United States Patent [19]

Hara

[11] Patent Number: 5,592,857

[45] Date of Patent: Jan. 14, 1997

[54] VARIABLE CAMSHAFT PHASER

[75] Inventor: Seinosuke Hara, Atsugi, Japan

[73] Assignee: Unisia Jecs Corporation, Atsugi, Japan

[21] Appl. No.: 389,312

[22] Filed: Feb. 16, 1995

[30] Foreign Application Priority Data

Feb. 16, 1994 [JP] Japan ..... 6-019083

[51] Int. Cl.[6] ..... F16H 53/00

[52] U.S. Cl. ..... 74/568 R; 123/90.15

[58] Field of Search ..... 74/567, 568 R; 123/48 R, 48 A, 48 AA, 48 D, 78 C, 78 D, 90.15, 90.11; 92/172; 464/2, 26

[56] References Cited

U.S. PATENT DOCUMENTS

| | | | |
|---|---|---|---|
| 2,861,557 | 11/1958 | Stolte | 123/90.15 |
| 3,050,964 | 8/1962 | Hogeman et al. | 464/26 X |
| 3,174,303 | 3/1963 | Watson | 464/2 |
| 3,258,937 | 7/1966 | Kranc et al. | 464/2 |
| 3,626,720 | 12/1971 | Meacham et al. | 64/25 |
| 3,828,558 | 8/1974 | Beale | 92/172 |
| 4,862,843 | 9/1989 | Kawamoto et al. | 123/90.11 |
| 5,195,469 | 3/1993 | Syed | 123/48 A |

FOREIGN PATENT DOCUMENTS 1-134011 5/1989 Japan .

*Primary Examiner*—Vinh T. Luong
*Attorney, Agent, or Firm*—Foley & Lardner

[57] ABSTRACT

A camshaft has a front part forming a journal part for a wheel of a timing pulley (a drive member). A stub shaft (a driven member) is secured to the front of the camshaft and disposed within a cylindrical body of the timing pulley. An annular slide is disposed and coacts with the cylindrical body and the stub shaft for phasing action. The magnitude of axial movement of the slide determines the magnitude of relative rotation between the timing pulley and stub shaft. Fixedly attached to a timing pulley cover is a body formed with a cylindrical bore receiving a piston and a valve bore receiving a spool of a valve for regulating supply of fluid to and discharge thereof from a pressure chamber defined by the piston in the cylindrical bore. A motor is fixedly attached to the timing pulley cover is coupled with a worm of a worm gearing including a worm gear. A motion connection between the piston and the slide is established by a piston rod, a push rod, a cross bar and a slide spring biasing the slide. A lever has one end abutting on an actuator pin for a spool of the valve and the opposite end pivoted to the worm gear. The lever is operatively coupled with the piston rod. The lever provides a position feedback of the piston rod to the valve.

18 Claims, 4 Drawing Sheets

VARIABLE CAMSHAFT PHASER

BACKGROUND OF THE INVENTION

1. Field of the Invention

The present invention relates to a variable camshaft phaser for an internal combustion engine.

2. Description of the Prior Art

JP-A 1-134011 discloses a variable camshaft phaser for an internal combustion engine of the type having a camshaft for actuating cylinder valves. According to this known device, the magnitude of relative rotational movement between a cylindrical body of a timing pulley and a stub shaft fixedly secured to a camshaft is determined by the magnitude of axial movement of a slide disposed between the cylindrical body and the stub shaft. The stub shaft is secured to the front end of a camshaft. The slide is integral with a piston disposed in the cylindrical body to define a pressure chamber. A sleeve is slidably disposed within a bore in the stub shaft and biased by a coil spring against the piston so that the piston integral with the slide moves the sleeve against the coil spring in response to supply of oil to the pressure chamber. Slidably disposed in the sleeve is a spool. A motor is fixedly attached to a timing pulley cover and coupled with an actuator pin for the spool to move the spool axially. The spool and sleeve cooperate with each other to form a valve for regulating supply of oil to and discharge thereof from the pressure chamber. The sleeve is formed with an inner circumferential groove and an axial bore communicating with this groove and opening to the pressure chamber. Drilled through the sleeve is a through bore extending from the outer periphery to the inner periphery. This through bore communicates with a passage in the stub shaft to always receive oil from an oil gallery of the engine. The spool has outer circumferential transfer groove. The spool has a closed position in which both supply of oil to and discharge thereof from the pressure chamber are blocked, a supply position in which the transfer groove of the spool establishes fluid communication between the through bore of the sleeve and the inner circumferential groove of the sleeve so that supply of oil to the pressure chamber is allowed, but discharge of oil from the pressure chamber is blocked, and a discharge position in which the inner circumferential groove of the sleeve is drained so that supply of oil to the pressure chamber is blocked and discharge of oil from the pressure chamber is allowed.

An object of the present invention is to provide an alternative to the variable camshaft phaser of the kind mentioned above.

SUMMARY OF THE INVENTION

According to another aspect of the invention, there is provided a variable camshaft phaser comprising:

coaxial drive and driven members;

coupling means including a slide disposed between said drive and driven members for permitting relative rotational movement between said drive and driven members in response to axial movement of said slide such that the magnitude of relative rotational movement between said drive and driven members being determined by the magnitude of axial movement of said slide;

electro-hydraulic actuator including a piston slidably received in a cylindrical bore disposed outside of said drive and driven members, and mechanical means for establishing positive motion connection between said piston and said slide for causing axial movement of said slide corresponding to movement of said piston in said cylindrical bore.

DETAILED DESCRIPTION OF THE INVENTION

Figure 1:
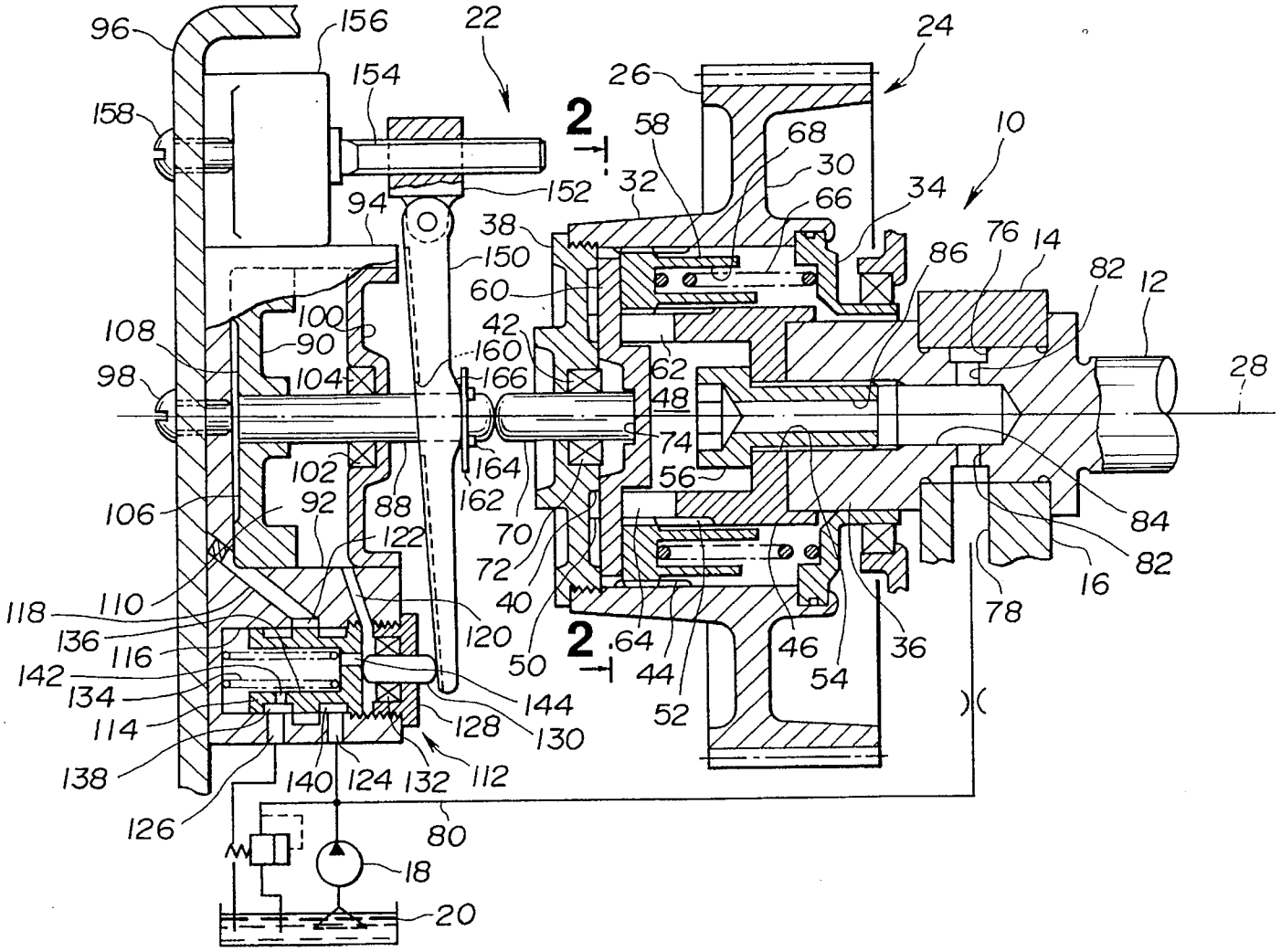
FIG. 1 is an axial sectional view of a variable camshaft phaser according to the present invention in one limit operational position.

Referring to FIG. 1, the reference numeral 10 generally indicates an internal combustion engine of the type having a camshaft 12 driven by a crankshaft, not shown. The camshaft 12 is rotatably supported by a bearing bracket 14 carried by the engine cylinder 16 in the known manner. The camshaft 12 carries a plurality of cams (not shown) for actuating cylinder valves (not shown) of the engine in the known manner. The cylinder valves are intake valves in this embodiment although they may be exhaust valves. The reference numeral 18 indicates an oil pump directly driven by the crankshaft. The reference numeral 20 indicates an oil pan.

On the front, driven, end of the camshaft 12, there is a variable camshaft phaser (VCP) 22 that includes a drive member in the form of a timing pulley 24. The timing pulley 24 includes a wheel 26 that is drivingly engaged by a timing belt, not shown, for rotatably driving the timing pulley 24 about an axis 28 that is coaxial with the camshaft 12. Within the wheel 26 is a radially extending hub 30. The timing pulley 24 further includes a cylindrical body 32 disposed within the wheel 26 and connected to the radially extending hub 30. The cylindrical body 32 fixedly holds at a rear end portion a retainer 34. The retainer 34 abuts on a front part 36 of the camshaft 12. This front part 36 of the camshaft 12 forms a journal shaft and a centering pin for the wheel 26. The cylindrical body 32 extends forwardly from the retainer 34 and has at a front end thereof a cover 38. The cover 38 has a peripheral edge tapped to threadedly engage the cylindrical body 32. The cover 38 has a central inwardly projected boss 40 formed with a central opening 42. The cylindrical body 32 has an internal helical spline 44.

The variable camshaft phaser 22 further includes a driven member in the form of a stub shaft 46. The stub shaft 46 has a bore 48 that receives the central inwardly projected boss 44. The stub shaft 46 has at one or front end a collar portion 50 abutting on the periphery of the central boss 40. The stub shaft 46 includes an external helical spline 52 adjacent the front end thereof. The stub shaft 46 has the opposite or rear end closing the bore 48. The rear end of the stub shaft 46 is secured through a central opening 54 to the front end of the camshaft 12 by a bolt 56 such that the cylindrical body 32 and stub shaft 46 are held in coaxial relationship.

The facing splines 44 and 52 have opposite and, preferably equal leads (or helix angles) to provide for phasing action. Between and engaging both splines 44 and 52 is an annular slide 58. The annular slide 58 has inner and outer helical splines drivingly mated with the splines 52 and 44 of the coaxial stub shaft 46 and cylindrical body 32, respectively.

Figure 2:
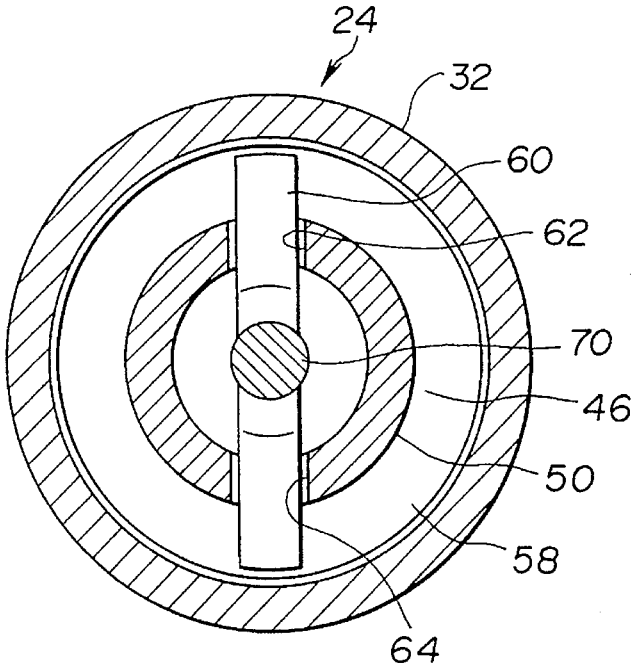
FIG. 2 is a cross sectional view taken through the line 2—2 of FIG. 1.
Figure 3:
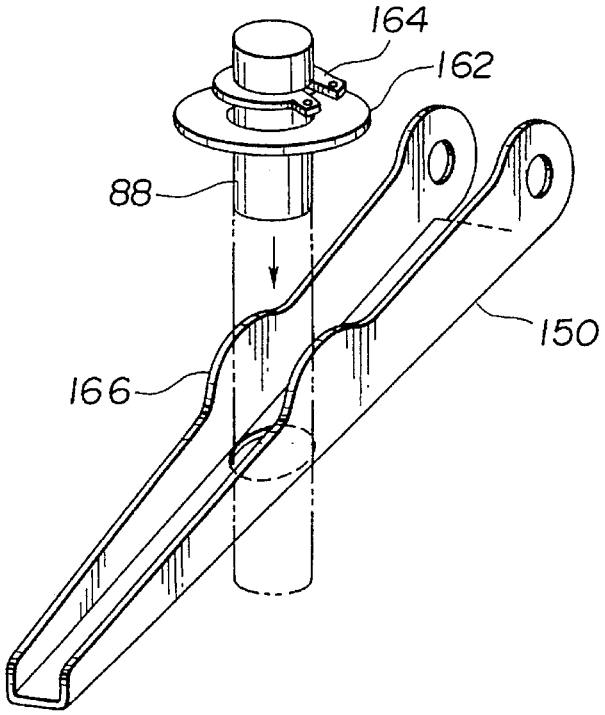
FIG. 3 is an exploded view of a lever and piston rod assembly.

Referring also to FIG. 2, a cross bar 60 is slidably received in a pair of diametrically opposed slots 62 and 64 cut axially inwardly from the front end of the stub shaft 46. The cross bar 60 extends through the slots 62 and 64 and has one and opposite end portions disposed between the cover 38 and annular slide 58. The cross bar 60 and annular slide 58 are urged in a direction toward the cover 38 by a coil spring 66 that extends between an end of a recess 68 in the annular slide 58 and the retainer 34.

A push rod 70 extends through the central opening 42 of the cover 38. A seal element 72 surrounds the push rod 70 to seal a space between the periphery of the push rod 70 and the adjacent wall of the cover 38 defining the central opening 42. The push rod 70 is supported by the cover 38 and abuts on the cross bar 60 at a rear end, i.e., a right end viewing in FIG. 1. The cross bar 60 has at a center thereof a recess 74 receiving the rear end of the push rod 70.

Lubrication oil is supplied to a circumferential groove 76 of the camshaft 12 through a passage 78 in the engine cylinder 16. This passage 78 receives lubrication oil from an oil gallery 80. Via this circumferential groove 76, the bearing bracket 14 is lubricated.

The circumferential groove 76 has radial openings 82 at its bottom wall and communicates through these radial openings 82 with an axial bore 84 of the camshaft 12. The bolt 56 is formed with an axial through passage 86 to establish fluid communication between the axial bore 84 and the bore 48 of the stub shaft 46. Lubrication oil is supplied to the bore 48 through the radial openings 82, axial bore 84 and axial passage 86.

Acting on a front end of the push rod 70 is a piston rod 88 of a piston 90. The piston 90 is slidably received in a cylindrical bore 92 of a body 94 that is fixedly attached to an inner face of a timing belt cover 96 of the engine 10 by means of a plurality of bolts, only one being shown at 98. The cylindrical bore 92 is closed by an end plug 100 having an outer periphery fixedly restrained by the body 94 by press-fit. The end plug 100 has a central opening 102 through which the piston rod 88 is slidably guided. A seal element 104 surrounds the periphery of the piston rod 88 and seals a space between the piston rod 88 and the adjacent wall of the end plug 100 defining the central opening 102. The piston 90 defines in the cylindrical bore 92 a pressure chamber 106 between the closed end of the cylindrical bore 92 and a pressure acting face 108 of the piston 90. The piston 90, piston rod 88 and end plug 100 cooperate with each other to define in the cylindrical bore 92 an annular chamber 110 between the piston 90 and end plug 100.

Figure 4:
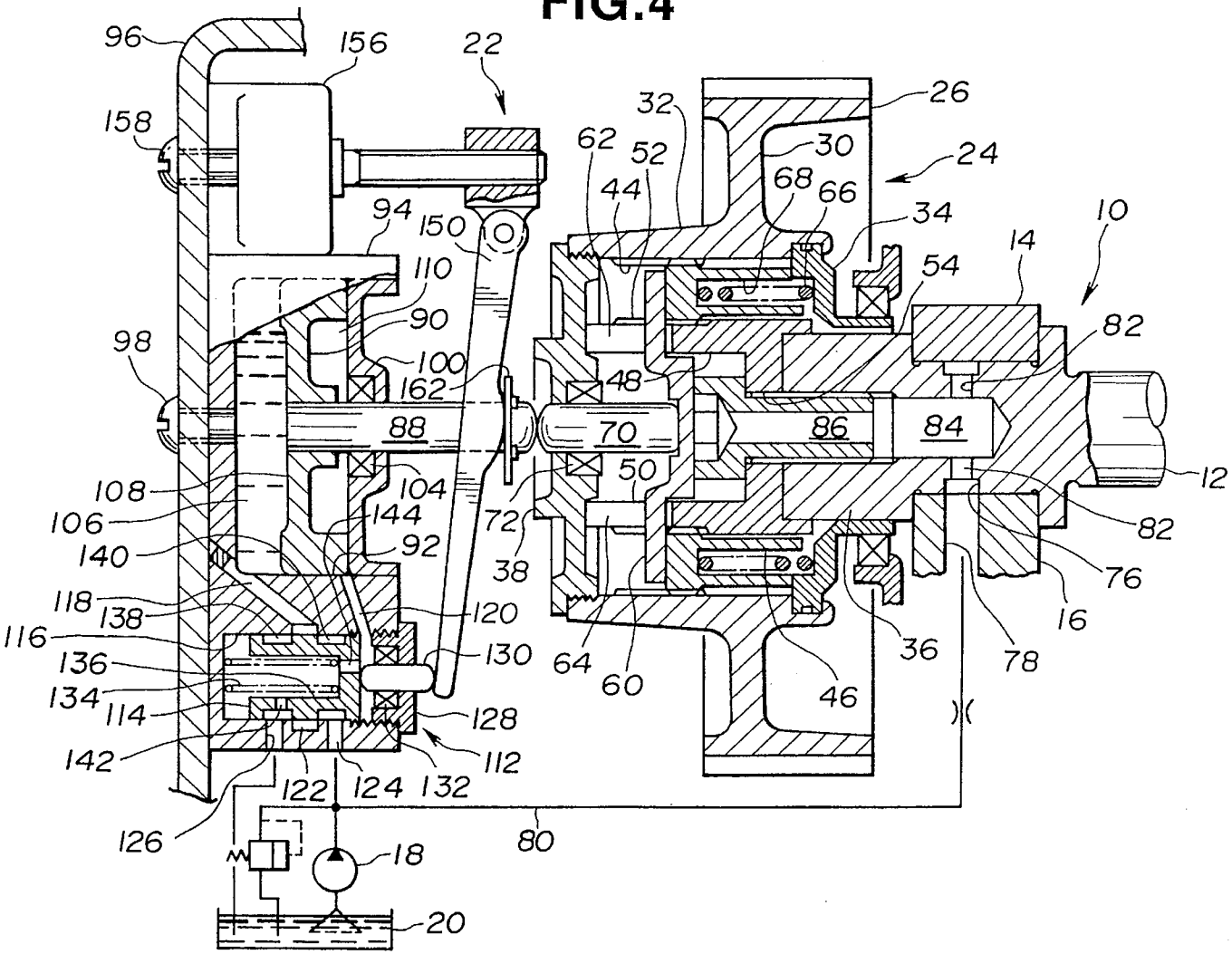
FIG. 4 is an axial sectional view similar to FIG. 1 and illustrates the variable camshaft phaser in another limit operational position.

The setting of the coil spring 66 is such that when the pressure chamber 106 is drained, the piston 90 abuts on the closed end of the cylindrical bore 92 to assume one limit operational position as illustrated in FIG. 1. As pressure within the pressure chamber 106 increases, the piston 90 moves toward the end plug 100. This movement of the piston 90 is transmitted via the piston rod 88, push rod 70, cross bar 60 to the slide 58, resulting in movement of the slide 58 toward the retainer 34 against the bias of the coil spring 66. The piston 90 is moveable to another limit operational position, as illustrated in FIG. 4, where it abuts on the end plug 100. When the piston 90 is in the limit operational position as illustrated in FIG. 4, the slide 58 abuts on the retainer 34.

The setting of the facing helical splines 44 and 52 and the splines of the annular slide 58 is such that the phasing relation between the timing pulley 24 and the camshaft 12 continuously varies as the slide 58 moves corresponding to movement of the piston 90 between the limit operational position as illustrated in FIG. 1 to the another limit operational position as illustrated in FIG. 4.

Supply of oil to and discharge of oil from the pressure chamber 106 is regulated by a valve 112. The valve 112 includes a spool 114 slidably disposed in a cylindrical valve bore 116 with which the body 94 is formed. The cylindrical bores 116 and 92 are cut inwardly from the common flat face of the body 94 in the same direction and disposed adjacent to each other. The body 94 is formed with two passages, namely, an oil supply passage 118 and a vent passage 120. The oil supply passage 118 has one end opening at the bottom wall of a circumferential groove 122 surrounding and opening to the cylindrical valve bore 116 at a portion intermediate the closed and open ends of the cylindrical valve bore 116. The oil supply passage 118 always communicates with the pressure chamber 106. The vent passage 120 has one end opening to the cylindrical valve bore 116 at a portion between the open end of the valve bore 116 and the circumferential groove 122. The opposite end of the vent passage 120 is always open to the annular chamber 110. The body 94 is formed also with an oil inlet port 124 and a drain port 126. These ports 124 and 126 are drilled inwardly from the outer periphery of the body 94. The oil inlet port 124 is open to the cylindrical valve bore 116 at a portion between the circumferential groove 122 and the portion at which the vent passage 120 is open to the valve bore 116. The drain port 126 is open to the valve bore 116 at a portion between the closed end of the valve bore 116 and the circumferential groove 122. The open end of the valve bore 116 is closed by an end plug 128. The end plug 128 slidably supports an actuator pin 130 and a seal element 132. The end plug 128 is threadedly engaged with internal thread formed on the cylindrical wall of the valve bore 116 adjacent the open end thereof. The actuator pin 130 extends through the end plug 128 and has an inner end abutting on the adjacent axial end of the spool 114. The spool 114 is biased by a coil spring 134 extending between the closed end of the valve bore 116 and an end of an axial recess 136 in the spool 114. Owing to the bias of the coil spring 134, the spool 114 is kept in contact with the actuator pin 130.

Figure 5:
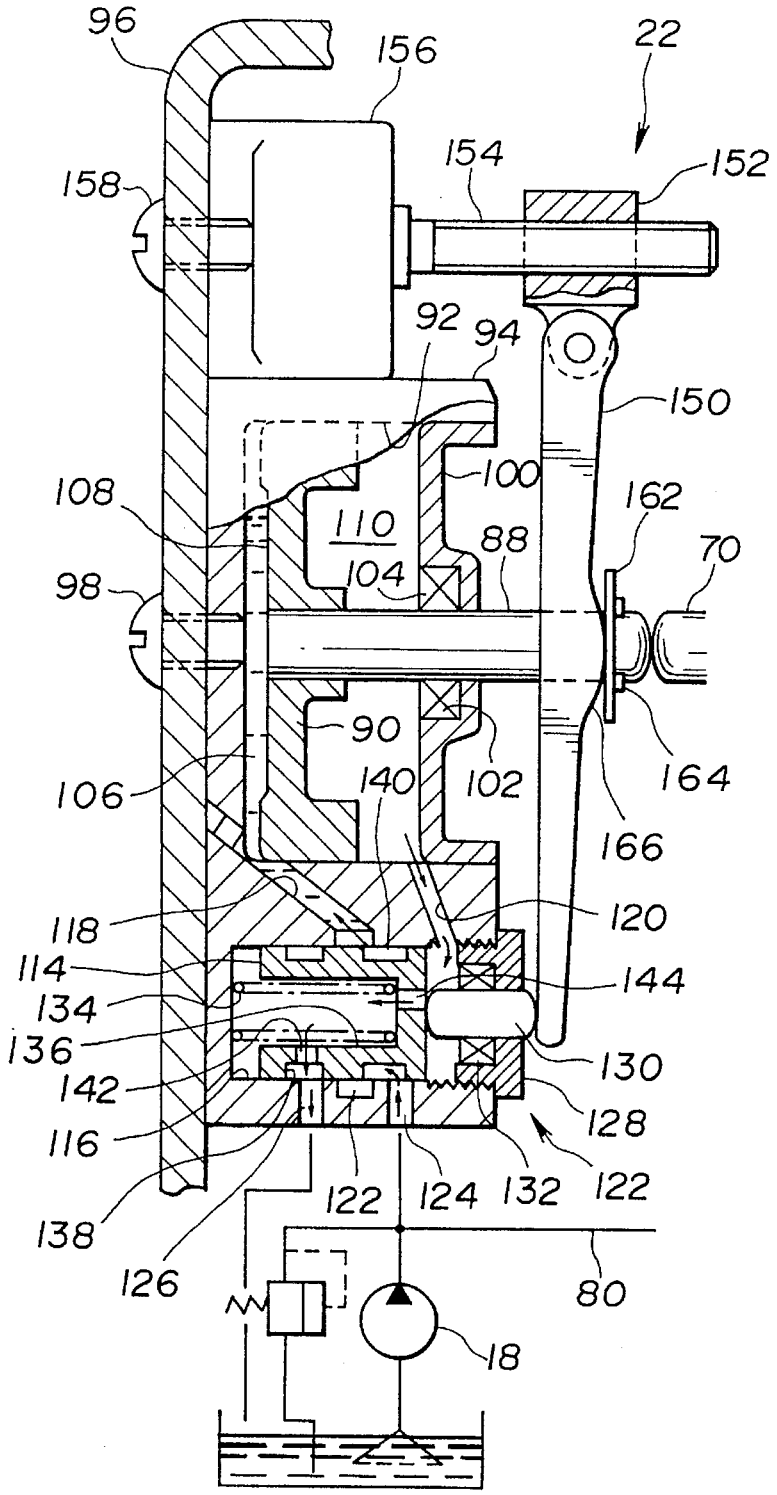
FIG. 5 is a partial sectional view similar to FIG. 1 and illustrates the variable camshaft phaser in a transient state from the one limit operational position to an operational position between the one and another limit operational positions.

The spool 114 is formed with two axially spaced circumferential grooves, namely, a discharge groove 138 and a supply groove 140. The discharge groove 138 always communicates with the drain port 126. The supply groove 140 always communicates with the inlet port 124. The spool 114 is further formed with a radial opening 142 between the discharge groove 138 and the axial recess 136, and with an axial opening 144 through the closed end thereof. Via these openings 142, 144 and axial recess 136, all of the spaces that the spool 114 defines within the valve bore 116, except a space defined in the supply groove 140, are drained via the drain port 126. The spool 114 is movable to three operational positions, namely, a supply position as illustrated in FIG. 5, a closed position as illustrated in FIG. 1 or 4, and a discharge position. In the supply position as illustrated in FIG. 5, the circumferential groove 122 is uncovered and communicates with the supply groove 140, allowing supply of oil from the inlet port 124 to the oil supply passage 118 and then to the pressure chamber 106, causing a pressure increase in the pressure chamber 106. This causes the piston 90 to move to the right as viewed from FIG. 5. During this rightward movement of the piston 90, the annular chamber 110 decreases in volume owing to discharge of fluid through the vent passage 120, axial opening 144, axial recess 136, radial opening 142, discharge groove 138 to the drain port 126. In the closed position as illustrated in FIG. 1 or 4, the circumferential groove 122 is covered and prevented from communicating with the supply groove 140 and discharge groove 138, either. The spool 114 is movable to the right, viewing in FIG. 1, beyond the closed position to assume the discharge position. In the discharge position, the circumferential groove 122 is uncovered to communicate with the discharge groove 138, allowing discharge of oil displaced by the spring 66 biased piston 90 out of the pressure chamber 106 through the passage 118, circumferential groove 122, and discharge groove 138 to the drain port 126.

The spool 114 is shiftable in operational position by the actuator pin 130 that projects outwardly of the end plug 128 to abut on one end portion of a lever 150. The amount of projection of the actuator pin 130 is restrained by the lever 150.

The opposite end portion of the lever 150 is pivotally supported by a guide wheel in the form of a worm gear 152 receiving and engaged with a worm 154. The worm 154 is drivingly coupled with a stepper motor 156 for rotation about its axis. Owing to the worm gearing 152 and 154, turning the worm 154 will cause the guide wheel 152 to move along the axis of the worm 154. The stepper motor 156 is arranged adjacent the body 94 and fixedly attached to the timing belt cover 96 by means of a bolt 158. The worm 154, piston rod 88 and actuator pin 130 extend in parallel, and the worm 154 and actuator pin 130 are angularly displaced around the piston rod 88 through 180 degrees. At an intermediate portion between the one and opposite end portions, the lever 150 is formed with a window 160 through which the piston rod 88 extends. A stop ring 162 is coupled with the piston rod 88 and restrained by a snap ring 164 from moving away from a lobe portion 166 of the lever 150. Owing to the spring 134 of the valve 112, the actuator pin 130 biases the lever 150 to keep the lobe portion 166 in contact with the stop ring 164, allowing the lever 150 to follow movement of the piston rod 88. This arrangement provides position feedback of the piston rod 88 to the valve 112.

As the stepper motor 156 turns to cause the worm gear 152 to move from the position as illustrated in FIG. 1 to the position as illustrated in FIG. 4, the lever 150 moves clockwise with the lobe portion 166 in contact with the stop ring 162. The actuator pin 130, in response to the movement of the lever 150, moves the spool 114 against the spring 134 to the supply position thereof, causing a pressure increase in the pressure chamber 106. As the pressure in the pressure chamber 106 increases, the piston 90 and piston rod 88 move to the right, viewed from FIG. 1. Movement of the piston rod 88 causes the slide 58 to move against the spring 66. This movement of the slide 58 causes the stub shaft 46 and camshaft 12 to turn relative to the timing pulley 24 in such a direction as to cause the phasing relationship of the camshaft 12 with the timing pulley 24 to vary in one direction. During this rightward movement of the piston 90, the piston rod 88 moves correspondingly, allowing the lever 150 to pivot about the worm gear 152 owing to the action of the coil spring 134 of the valve 112. This pivotal movement of the lever 150 repositions the spool 114 of the valve 112 to the closed position as illustrated in FIG. 4. Thus, the supply of oil to the pressure chamber 106 is interrupted.

Subsequently, as the stepper motor 156 turns to cause the worm gear 152 to move from the position as illustrated in FIG. 4 to the position as illustrated in FIG. 1, the lever moves counterclockwise, as viewed from FIG. 4, with the lobe portion 166 in contact with the stop ring 162. The actuator pin 130, in response to the movement of the lever 150, projects beyond the position as illustrated in FIG. 4, allowing the spring 134 to move the spool 114 to the discharge position thereof, causing a pressure drop in the pressure chamber 106. As the pressure in the pressure chamber 106 decreases, the piston 90 and piston rod 88 move to the left, as viewed from FIG. 4, owing to the action of the spring 66. Movement of the piston rod 88 allows the spring 66 to move the slide 58 toward the cover 38. This movement of the slide 58 causes the stub shaft 46 and camshaft 12 to turn relative to the timing pulley 24 in the opposite direction as to vary the phasing relation of the camshaft 12 with the timing pulley 24 in the opposite direction. During this leftward movement of the piston 90, the piston rod 88 moves correspondingly, moving the lever 150 to pivot about the worm gear 152. This pivotal movement of the lever 150 repositions the spool 114 of the valve 112 to the closed position as illustrated in FIG. 4. Thus, the discharge of oil from the pressure chamber 106 is interrupted.

FIG. 5 illustrates a transient state immediately after the worm gear 152 has moved from the position as illustrated in FIG. 1 to an intermediate position as illustrated in FIG. 5 and before the lever 150 repositions the spool 114 to the closed position thereof. This transient state shifts to a balanced stable state where the piston 90 assumes a position corresponding to the intermediate position to which the worm gear 152 has taken and the spool 114 of the valve 112 assumes the closed position thereof.

As will be readily understood from the preceding description, the piston 90 and piston rod 88 assume the corresponding position between the one and another limit positions (see FIGS. 1 and 4) to an intermediate position to which the worm gear 152 takes. Thus, the phasing relation of the camshaft 12 relative to the timing pulley 24 can be adjusted anywhere between the limit positions in a continuous manner.

The piston 90 and valve 112 are disposed outside of the cylindrical body 32 of the timing pulley 24. Owing to this arrangement, the oil supply passage 118 and vent passage 120 have sufficiently large flow cross sectional areas, respectively. Since the spool 114 of the valve 112 is separated from the piston 90, the spool 114 has a sufficiently large diameter. By virtue of the increased diameter of the spool 114, the supply groove 140 and discharge groove 138 with which the spool 114 is formed have sufficiently large flow cross sectional areas, respectively. Thus, oil is supplied to the pressure chamber 106 at increased flow rate.

Since the piston 90 of sufficiently large diameter is used, the thrust that the piston 90 is subjected to is increased considerably.

The inlet port 124 is directly connected to the oil gallery 80 in an unrestricted manner and the drain port 126 is directly open to the oil pan 20 in an unrestricted manner, too.

It is therefore appreciated that the phasing relation of the camshaft 12 relative to the timing pulley 24 varies quickly, resulting in quick response.

The spool 114 moves temporarily to the supply position or discharge position during a transient state, only. In other words, the spool 114 assumes the closed position thereof during a stable state. This results in reduced consumption of oil.

In the embodiment, lubrication oil is supplied to the pressure chamber 106 from the oil gallery 80. High pressure oil used for a power-assist steering system may be supplied to the pressure chamber 106 since oil supply to the pressure chamber 106 is independent from lubrication oil supply to the cam bracket 14.

Oil supplied to the inside of the cylindrical body 32 of the timing pulley 24 is used for lubrication only and thus not required to keep high pressure. Thus, it is easy to prevent leak of oil.

In the embodiment, the cover 38 is detachably mounted to the cylindrical body 32 without any difficulty owing to the threaded engagement. This makes it easy to turn the bolt 56 upon mounting and removing the timing pulley 24 to and from the camshaft 12. This improves maintainability and assembly operation.

The valve 112 and stepper motor 156 are arranged around the piston 90 within a limited space available adjacent the rear face of the timing belt cover 96. Owing to this compact arrangement, an increase in axial dimension to the front face of the timing belt cover 96 from the front face of front part 36 of the camshaft 12 is suppressed.

What is claimed is:

1. A variable camshaft phaser comprising:

coaxial drive and driven members;

coupling means including a slide disposed between said drive and driven members for permitting relative rotational movement between said drive and driven members in response to axial movement of said slide such that the magnitude of relative rotational movement between said drive and driven members is determined by the magnitude of axial movement of said slide;

an electro-hydraulic actuator including a body formed with a cylindrical bore disposed outside of said drive and driven members, a piston slidably received in said cylindrical bore and defining in said cylindrical bore a pressure chamber, and a piston rod fixed to said piston, said cylindrical bore and defining in said cylindrical bore a pressure chamber, and a piston rod fixed to said piston, said piston being movable between two limit positions thereof;

a push rod supported by said driver member and having one end abutting on said piston rod and an opposite end;

a cross bar having one and opposite end portions abutting on said slide and a center portion receiving said opposite end of said push rod;

a slide spring acting on said slide in such a direction as to provide motion connection between said piston rod, said push rod, said cross bar, and said slide, wherein said electro-hydraulic actuator includes valve means for regulating supply of fluid to and discharge thereof from said pressure chamber, a worm gearing including a worm and a worm gear, a motor coupled with said worm for turning said worm, and a lever pivotally supported by said worm gear, said lever being so operatively connected to said position feedback of said piston rod to said valve means.

2. A variable camshaft phaser as claimed in claim 1, wherein said valve means include a spool, an actuator pin and a valve spring biasing said spool and said actuator pin to keep said actuator pin in abutting contact with said lever.

3. A variable camshaft phaser as claimed in claim 2, wherein said lever has one end portion abutting on said actuator pin and an opposite end portion pivotally supported by said worm gear.

4. A variable camshaft phaser as claimed in claim 3, wherein said lever is formed with a window through which said piston rod extends.

5. A variable camshaft phaser as claimed in claim 4, wherein said electro-hydraulic actuator further includes a stop ring fixedly retained by said piston rod.

6. A variable camshaft phaser as claimed in claim 5, wherein said lever has a lobe portion mating with said stop ring.

7. A variable camshaft phaser as claimed in claim 6, wherein said actuator pin of said valve means abuts on said lever to keep said lobe portion in contact with said stop ring.

8. A variable camshaft phaser as claimed in claim 7, wherein said spool of valve means has a supply position and a closed position.

9. A variable camshaft phaser as claimed in claim 8, wherein said valve means is adapted to block supply of fluid to and discharge thereof from said pressure chamber when said spool assumes said closed position thereof and to allow supply of fluid to said pressure chamber but block discharge of fluid from said pressure chamber when said spool assumes said supply position thereof.

10. A variable camshaft phaser as claimed in claim 9, wherein said mechanical means includes a slide spring acting on said slide in such a direction as to bias said piston rod toward said pressure chamber.

11. A variable camshaft phaser as claimed in claim 10, wherein said lever is adapted to push said actuator pin to urge said spool against said valve spring toward said supply position thereof in a transient state when said piston moves away from said pressure chamber.

12. A variable camshaft phaser as claimed in claim 11, wherein said lever is adapted to allow said valve spring to move said spool beyond said closed position thereof in a transient state when said piston moves toward said pressure chamber.

13. A variable camshaft phaser as claimed in claim 2, wherein said actuator pin of said valve means and said worm are displaced around said piston rod through 180 degrees.

14. A variable camshaft phaser as claimed in claim 13, wherein said body is fixedly attached to a timing pulley cover and said motor is fixedly attached to said timing pulley cover.

15. A variable camshaft phaser as claimed in claim 1, wherein said driven member includes a stub shaft formed with a pair of diametrically opposed slots through which said cross bar extends.

16. A variable camshaft phaser as claimed in claim 15, wherein said drive member includes a timing pulley including a wheel and a cylindrical body surrounding said stub shaft and said slide.

17. A variable camshaft phaser as claimed in claim 16, wherein said drive member further includes a cover fixedly retained by said cylindrical body, said cover being formed with a central opening through which said push rod extends.

18. A variable camshaft phaser as claimed in claim 17, wherein said driven member further includes a camshaft to which said stub shaft is fixedly attached.

* * * * *